United States Patent [19]

Mota

[11] Patent Number: 4,544,906

[45] Date of Patent: Oct. 1, 1985

[54] TRANSFORMER HAVING COAXIAL COILS

[75] Inventor: Joaquim S. Mota, V.N. Gaia, Portugal

[73] Assignee: U.S. Philips Corporation, New York, N.Y.

[21] Appl. No.: 659,102

[22] Filed: Oct. 9, 1984

[30] Foreign Application Priority Data

May 29, 1984 [NL] Netherlands ..... 8401708

[51] Int. Cl.[4] ..... H01F 27/32

[52] U.S. Cl. ..... 336/206; 336/208

[58] Field of Search ..... 336/198, 208, 206, 192; 310/194

[56] References Cited

U.S. PATENT DOCUMENTS 1,278,993 9/1918 Panks ..... 336/206

4,449,111 5/1984 Nakajima ..... 336/206

*Primary Examiner*—Thomas J. Kozma

*Attorney, Agent, or Firm*—Robert T. Mayer; Bernard Franzblau

[57] ABSTRACT

Transformer coils (19) are provided on a tubular section (5) of a coil former (3) at least one of the coils is separated from the next coil by mounting the second of said coils on an electrically insulating foil (41) wound around the first coil. Each of the two coils (19) is located in a winding space (27) which extends from the center of the tubular section (5) to both sides in the axial direction to boundaries (37) located at a predetermined distance from the ends thereof, whereas the foil (41) extends in the axial direction beyond those boundaries. In order to ensure an adequate insulation between the leads (17) of consecutive coils (19) and in order to enable subsequent thereto a simple check whether a coil (19) is indeed wholly contained within the prescribed winding space (27), the foil (41) extends in the axial direction substantially to the ends of the tubular section (5) and the foil is transparent and has visually observable marks (43) at the location of the boundaries (37) of the winding space (27).

6 Claims, 5 Drawing Figures

TRANSFORMER HAVING COAXIAL COILS

Figure 1:
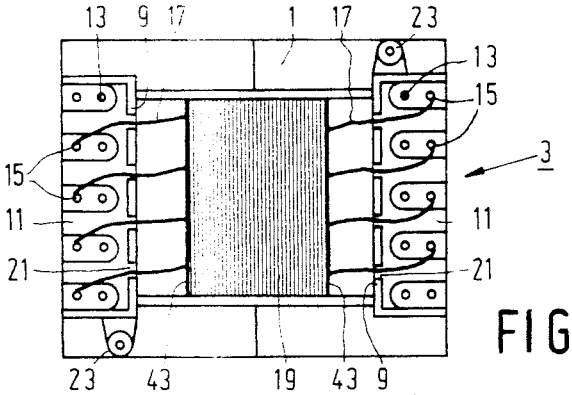

The invention relates to a transformer comprising a coil former made of an insulating material, having a tubular section on which a plurality of coaxial coils have been provided, at least one of these coils being separated from the next coil by arranging the second of said coils on an electrically insulating foil wrapped around the first coil, each of these two coils being arranged in a winding space which extends from the centre of the tubular section to both sides in the axial direction to boundaries which are located at a predetermined distance from the ends thereof, the foil extending in the axial direction to beyond the boundaries of at least the winding space of the first coil.

Such a transformer is disclosed in GB-A 1,246,458. The insulating foil between two consecutive coils functions to insulate these two coils from each other. In many cases it is a requirement that between two transformer coils which are insulated from each other there is a creepage path the length of which has at least a predetermined value, for example 6 mm. In the prior art transformer this requirement is satisfied in that steplike profiles are provided at the ends of the tubular section, the winding space of a coil extending between two steps of the steplike profiles while the foil and the winding space of the subsequent coil extend between the two subsequent steps.

The leads of the coils are passed to the exterior through slits in the profile, overhanging projections having been provided in the slits to prevent a lead from coming into the subsequent winding space. Consequently, the coil former for this transformer has a comparatively complicated shape and a mould for injection moulding it is therefore expensive. In addition, when the design of the transformer is changed, the coil former must usually also be changed, for example because the number of coils or the dimensions of the coils are changed. In that case a new, expensive mould must be made.

The invention has for an object to provide a transformer of the type set forth in the opening paragraph having a coil former which is simpler than that of the prior art transformer, and wherein many changes in the transformer design are possible without the necessity of changing the coil former, all of this such that always the requirements as regards the mutual insulation of the coils can be satisfied.

According to the invention, the transformer is therefore characterized in that the foil extends in the axial direction to substantially the ends of the tubular section, that the foil is transparent and that visually observable marks are provided on the foil at the location of the boundaries of the winding space of the first of the two coils.

Thanks to these measures the leads from the first coil to the end of the tubular section are covered by the foil so that lead-out slits with overhanging projections are not required. If flanges are present at the ends of the tubular section, simple lead-out slits without overhanging projections may be provided therein. In order to keep the coils within the winding space, a finger can be placed against the tubular section of the coil former in situ of each boundary of the winding space, during winding. After positioning of the coils the coil is visible through the foil and with the aid of the marks it is easy to check whether the coil is indeed completely contained within the winding space. This check is recommendable as it might happen that after the fingers have been removed one of the exterior windings of the coils moves outwards over a small distance before the position of the coil has been fixed definitely, for example with an adhesive. For the first coil on the coil former this risk can, if so desired, be still further limited if the winding space of this coil extends between two projections on the tubular section, said projections being present only on a part of the circumference of the tubular section so that the leads can be passed to the exterior along these projections. Projections of this nature are of a very simple shape and do not increase the production cost. They also have no negative influence on the ability to change the transformer design, such as choosing a different number of secondary windings or a different number of turns per secondary winding in order to obtain different secondary voltages.

A further simplification of the manufacture of the transformer according to the invention is possible when the transformer is characterized in that the boundaries of the winding spaces of all coils are located at the same distance from the ends of the tubular section. This makes it possible to maintain the same distance between the fingers during winding of all coils and to use the same type of foil for all coils.

In order to protect the transformer and to insulate it from the surroundings, with the possibility to check whether the last coil is totally enclosed within the winding space, a further preferred embodiment of the transformer according to the invention is characterized in that also around the last coil provided on the coil former a transparent, insulating foil has been wrapped, on which visually observable marks are provided at the location of the boundaries of the winding space of the last coil.

Figure 2:
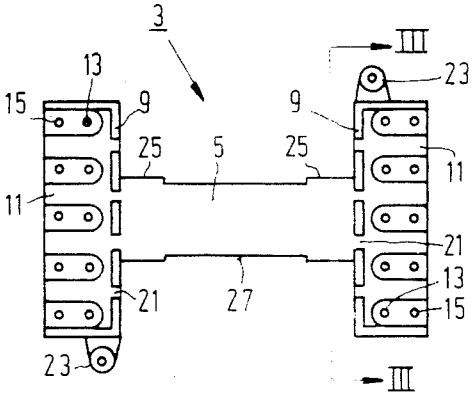
Figure 3:
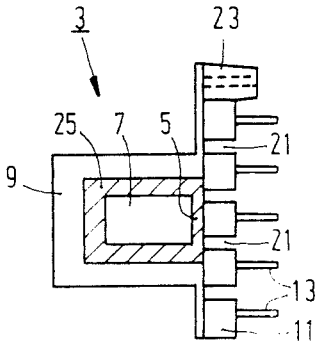
Figure 4:
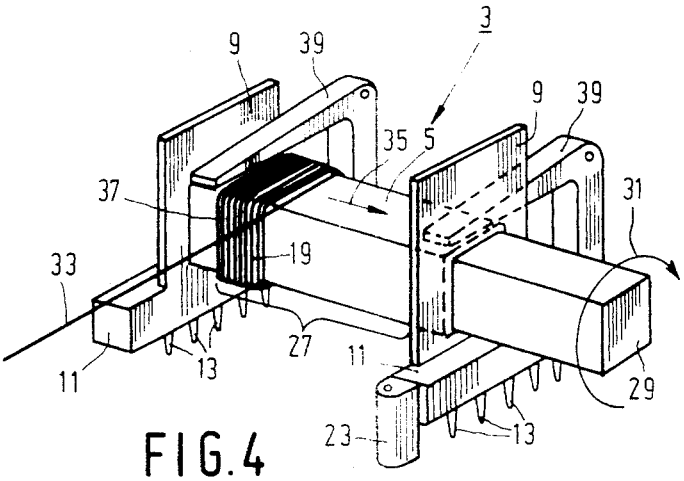
Figure 5:
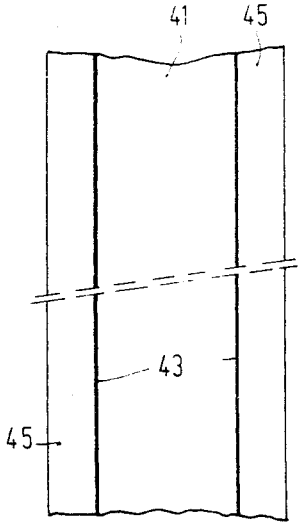

The invention will now be described in greater detail by way of example with reference to the accompanying drawing in which:

FIG. 1 shows a bottom view of an embodiment of a transformer according to the invention, FIG. 2 shows a bottom view of a coil former for the transformer shown in FIG. 1, FIG. 3 is a cross-sectional view through the coil former shown in FIG. 2, FIG. 4 is a greatly simplified perspective view of the coil former shown in FIG. 2 during winding of a coil, and FIG. 5 shows a strip of insulating foil.

The transformer shown in a bottom view comprises a ferromagnetic core 1 consisting of two E-shaped portions the centre limb (not visible) of which is inserted in an aperture provided in a coil former 3 made of an insulating material, for example plastics.

FIGS. 2 and 3 show a more detailed view of this coil former, FIG. 2 showing a bottom view corresponding to FIG. 1 and FIG. 3 being a cross-sectional view along the line III—III in FIG. 2. The coil former 3 has a tubular section 5 in which the aperture 7 for the core 1 is made. This tubular section extends between two flanges 9 having terminal strips 11 in which terminals 13 are secured. Each terminal 13 is, for example, formed by a limb of a U-shaped conductor which is embedded in the plastics material of the coil former 3 such that its two limbs project to the exterior. The other limb then forms a pin 15 for fastening a lead of a coil wound on the coil former 3. FIG. 1 shows how the leads 17 of coils 19 (of which only the outermost is visible) wound coaxially on the coil former 3 extend to the pins 15 via slits 21 recessed in the flanges 9. In addition, the terminal strips 11 are provided with eye-holes 23 for mounting the transformer in an apparatus.

The tubular section 5 of the coil former has a rectangular cross-section. Projections 25 which extend along a part of the circumference, namely along three of the four sides of the rectangle, are provided near the coil former ends. A winding space 27 for winding a first coil 19 on the coil former 3 extends between the projections 25. Since no projections 25 are present at the bottom of the tubular section 5 the leads of this coil can be passed without difficulty to the slits 21.

FIG. 4 shows very schematically how the coils 19 are wound. For that purpose the coil former 3 is placed on a rectangular mandrel 29 which fits in the aperture 7. The mandrel 29 forms part of a winding machine, not shown further, and is capable of rotation together with the coil former 3 around its axis as indicated by means of the arrow 31. An electrically conducting wire 33 is passed from a storage reel (not shown) to the tubular section 5 of the coil former 3 via a wire guide (also not shown). While the coil former rotates around its axis, the wire guide moves in the direction indicated by the arrow 35 so that a layer of a coil 19 is wound on the tubular section 5. This coil is present in a winding space 27 which extends from the centre of the tubular section 5 in the axial direction to both sides to boundaries 37 which are located at a predetermined distance, for example 6 mm, from the ends of this tubular section. So as to keep coil 19 within the winding space during winding, fingers 39 engage in the region of the boundaries 37 the tubular section 5, between which the wire guide with the wire 33 moves. The coil 19 may consists of one or a plurality of layers. After the number of turns required for the coil has been provided, the fingers 39 are removed from the tubular section 5 and the turns are fixed, for example using strips of adhesive tape (not shown). As mentioned in the foregoing, the winding space 27 of the first coil 19 wound on the coil former 3 is not only limited by the fingers 39 but also permanently by the projections 25. The leads 17 (see FIG. 1) of all coils 19 are passed to the pins 15 via the slits 21.

After winding and fixing the coil 19 a strip of electrically insulating foil 41, shown in FIG. 5, is wound around this coil. The width of the foil strip is substantially equal to the length of the tubular section 5 of the coil former 3, so that the foil extends approximately from one flange 9 to the other. The foil consists of an electrically insulating transparent plastic, on which visually observable marks have been provided at the location of the boundaries 37 of the winding space 27, for example in the form of opaque lines 43. A further possibility is that the edge sections 45 of the foil strip 41 extending to beyond the winding space 27 are transparent and have a colour which differs from the colour of the centre section, it not being an absolute requirement for the centre section to be transparent. In that case the marks 43 are formed by the transition from one colour to the other.

After the foil 41 has been wound around the coil 19 no coil portions may be visible in the edge portions 45. Should coil portions be indeed visible, the distance between the coil 19 and one end of the tubular section 5 is less than the prescribed distance, so that the creepage path between that coil and a preceding or a subsequent coil does not satisfy the regulations. Thus the transformer can be checked in a very simple way.

When the boundaries 37 of the winding spaces 27 of all the consecutively wound coils 19 are spaced by the same distsnce from the ends of the tubular section 5, both manufacture and checking of the transformer are extremely simple. Namely, in that case the same fingers 39 can be used during winding of each coil 19 and a simultaneous check of all coils is possible after the last coil has been wound. To that end also, this last coil is preferably provided with a foil strip 41, as shown in FIG. 5, whereafter it can be checked whether a portion of one of the coils 19 is visible in the edge portions 45. In addition, this last foil strip 41 insulates the last coil 19 from the environment and at the same time provides a certain mechanical protection of this coil.

As mentioned in the foregoing, after each coil 19 has been wound its leads 17 are passed to the exterior through the slits 21, where they can be connected to the pins 15. A different possibility is to connect the leads directly to further components in a circuit in which the transformer is used. In that case the terminal strips 11 and, if so desired, also the flanges 9 may be omitted.

The run-out leads 17 are covered in the region between the boundaries 37 of the winding space 27 and the ends of the tubular section by the edge portion 45 of the foil strip 41. This results in a creepage path of a sufficient length, also between the leads 17 of the consecutive coils 19, provided it is ensured that in the circumferential direction of the tubular section 5 these leads are sufficiently spaced from each other. In the example shown this distance is predominantly determined by the mutual distances between the slits 21 if care is taken to ensure that each leads leaves the coil 19 approximately directly opposite the associated slits. If no flanges 9 are provided, care must be taken during winding that the leads are spaced sufficiently far from each other. This also can be easily checked after winding of the last coil since the leads are visible in the transparent edge portions 45 of the foil strip 41.

What is claimed is:

1. A transformer comprising a coil former made of an insulating material having a tubular section supporting a plurality of coaxial coils, a second of said coils being located on an electrically insulating foil wrapped around a first coil such that the foil separates the first and second coils, each of the two coils being arranged in a winding space which extends from the centre of the tubular section to both sides in the axial direction to boundaries located at a predetermined distance from the ends thereof, the foil extending in the axial direction to beyond the boundaries of at least the winding space of the first coil to substantially the ends of the tubular section, the foil being transparent with visually observable marks provided thereon at the location of the boundaries of the winding space of the first of the two coils.

2. A transformer as claimed in claim 1, wherein the winding space of the first coil provided on the coil former extends between two projections on the tubular section, said projections being present only on a part of the circumference of the tubular section.

3. A transformer as claimed in claim 1 wherein the boundaries of the winding spaces of all of the coils are located at the same distances from the ends of the tubular section.

4. A transformer as claimed in claim 1 wherein around the last coil provided on the coil former a transparent insulating foil is wrapped on which visually observable marks are provided at the location of the boundaries of the winding space of the last coil.

5. A transformer as claimed in claim 2 wherein the boundaries of the winding spaces of all of the coils are located at the same distances from the ends of the tubular section.

6. A transformer as claimed in claim 2 further comprising a transparent insulating foil wrapped around the last coil on the coil former, said foil having visually observable marks provided at the location of the boundaries of the winding space of the last coil.

* * * * *

UNITED STATES PATENT AND TRADEMARK OFFICE

CERTIFICATE OF CORRECTION

PATENT NO. : 4,544,906

DATED : October 1, 1985

INVENTOR(S) : JOAQUIM S. MOTA

It is certified that error appears in the above-identified patent and that said Letters Patent is hereby corrected as shown below:

In the ABSTRACT Line 2, change "at" to -- . At--.

Signed and Sealed this

Twenty-fifth Day of November, 1986

*Attest:*

DONALD J. QUIGG

*Attesting Officer* *Commissioner of Patents and Trademarks*